US006471523B1

(12) United States Patent
Shuey

(10) Patent No.: US 6,471,523 B1
(45) Date of Patent: Oct. 29, 2002

(54) ELECTRICAL POWER CONNECTOR

(75) Inventor: Joseph B. Shuey, Camp Hill, PA (US)

(73) Assignee: Berg Technology, Inc., Reno, NV (US)

( * ) Notice: Subject to any disclaimer, the term of this patent is extended or adjusted under 35 U.S.C. 154(b) by 0 days.

(21) Appl. No.: 09/511,389

(22) Filed: Feb. 23, 2000

(51) Int. Cl.[7] ..... H01R 9/09
(52) U.S. Cl. ..... 439/63; 439/947
(58) Field of Search ..... 439/63, 591, 947, 439/857

(56) References Cited

U.S. PATENT DOCUMENTS

| | | | | | |
|---|---|---|---|---|---|
| 4,448,467 | A | | 5/1984 | Weidler | |
| 4,494,816 | A | | 1/1985 | Tamburro | 339/177 R |
| 4,519,666 | A | * | 5/1985 | Williams et al. | 439/578 |
| 4,605,269 | A | | 8/1986 | Cohen et al. | 339/17 LC |
| 4,734,041 | A | | 3/1988 | Bruchmann et al. | 439/637 |
| 4,759,729 | A | | 7/1988 | Kemppainen et al. | 439/580 |
| 4,846,719 | A | | 7/1989 | Iwashita | 439/63 |
| 4,975,066 | A | | 12/1990 | Sucheski et al. | 439/63 |
| 5,169,324 | A | | 12/1992 | Lemke et al. | 439/101 |
| 5,516,294 | A | | 5/1996 | Andrews et al. | 439/63 |
| 5,533,901 | A | * | 7/1996 | Hunt et al. | 439/947 |
| 5,599,213 | A | * | 2/1997 | Frommer et al. | 439/857 |
| RE35,508 | E | | 5/1997 | Lemke et al. | 439/101 |
| 5,797,770 | A | | 8/1998 | Davis et al. | 439/607 |
| 5,807,117 | A | * | 9/1998 | Kempl et al. | 439/63 |
| 5,820,390 | A | | 10/1998 | Takamoto et al. | 439/78 |
| 6,019,639 | A | * | 2/2000 | Brunker et al. | 439/637 |
| 6,162,093 | A | | 12/2000 | Sudol et al. | 439/607 |

FOREIGN PATENT DOCUMENTS

| | | |
|---|---|---|
| CA | 1 148 628 | 6/1983 |
| EP | 0 405 454 A2 | 1/1991 |
| EP | WO 99/19943 | 4/1999 |
| GB | 2 104 312 A | 2/1983 |
| WO | WO 99/19943 | 4/1999 |

* cited by examiner

*Primary Examiner*—Neil Abrams
*Assistant Examiner*—Phuong Dinh
(74) *Attorney, Agent, or Firm*—Harrington & Smith, LLP

(57) ABSTRACT

An electrical power connector comprising a housing, a first power contact, and a second power contact. The first contact is connected to the housing. The first contact comprises at least two contact beams. The second contact is connected to the housing. The second contact comprises at least two contact beams located outside and generally parallel to the contact beams of the first contact. The second contact comprises a separate connection section for each of the contact beams. The first and second contacts are located in close proximity relative to each other of less than about 30 mils (0.8 mm) along a majority of their lengths.

11 Claims, 4 Drawing Sheets

ELECTRICAL POWER CONNECTOR

BACKGROUND OF THE INVENTION

1. Field of the Invention

The present invention relates to electrical power connectors and, more particularly, to a coaxial electrical power connector.

2. Brief Description of Earlier Developments

U.S. Pat. No. 5,516,294 discloses a coaxial interconnection system for signal terminals. PCT publication No. WO99/19943 discloses an outer ground contact and an inner signal contact connected by a dielectric layer between the two contacts.

Coaxial connectors, used on transmission lines, have been used for years. The reason coaxial connectors are used is that they have the capability of closely matching the impedance of the transmission line. A low inductance connector is a low impedance connector. In certain power applications relating to electronic components, power connectors, and in particular power connectors which are not low impedance and low inductance, can cause problems in the electronic components. In particular, such power connectors can introduce unwanted turn-on voltage transients. Also, the power connectors can generate false signals or corrupt signals in near-by signal transmission pathways or contacts. What is needed in modern (computer) power applications is a low inductance power connector.

It is desired to provide low inductance power interface such as those between power supplies and power consuming devices, or even between DC to DC converters and power consuming devices. It is also desired to provide a power connector with minimized power distribution impedance and minimized common mode voltage transients.

SUMMARY OF THE INVENTION

In accordance with one embodiment of the present invention, an electrical power connector is provided comprising a housing, a first power contact, and a second power contact. The first contact is connected to the housing. The first contact comprises at least two contact beams. The second contact is connected to the housing. The second contact comprises at least two contact beams located outside and generally parallel to the contact beams of the first contact. The second contact comprises a separate connection section for each of the contact beams. The first and second contacts are located in close proximity relative to each other of less than about 30 mils (0.8 mm) along a majority of their lengths.

In accordance with another embodiment of the present invention, a coaxial electrical power connector is provided comprising a housing, a first contact, and a second contact. The first contact is connected to the housing. The first contact comprises a stamped and formed member having at least two cantilevered contact beams. The second contact is also connected to the housing. The second contact comprises a stamped and formed member having at least two contact beams located outside the contact beams of the first contact and separately deflectable relative to the contact beams of the first contact. When a mating connector is connected with the coaxial electrical power connector, portions of the contact beams of the first contact project into receiving areas of contact arms of the second contact. The first and second contacts are located generally parallel to each other in close proximity to each other along a majority of the lengths of the contacts such that the connector can provide a low impedance and low inductance power connection to the mating connector.

In accordance with one method of the present invention, a method of assembling an electrical power connector is provided comprising steps of providing a first contact having two contact beams, the first contact comprising a stamped and formed member; providing a second contact having two contact beams, the second contact comprising a stamped and formed member; and connecting the first and second contacts to each other with their contact beams being located generally parallel to each other in a coaxial pattern. The step of connecting locates the first and second contacts in close proximity to each other along a majority of lengths of the contacts. A spacing between the contacts is less than about 30 mils (0.8 mm) along the majority of the contacts' lengths.

BRIEF DESCRIPTION OF THE DRAWINGS

The foregoing aspects and other features of the present invention are explained in the following description, taken in connection with the accompanying drawings, wherein.

DETAILED DESCRIPTION OF THE PREFERRED EMBODIMENT

Figure 1:
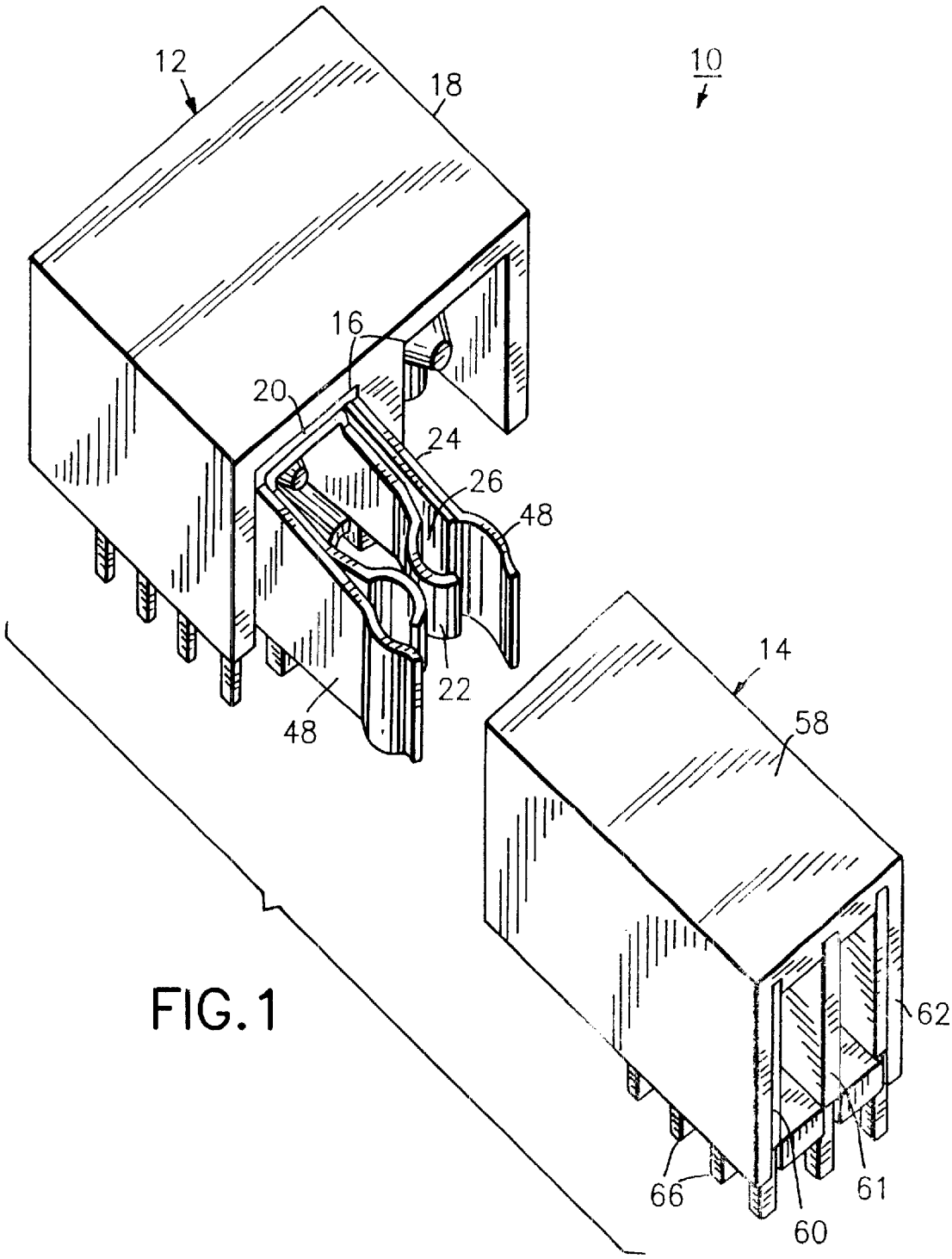
FIG. 1 is an exploded perspective view of an electrical connection system incorporating features of the present invention.

Referring to FIG. 1, there is shown an exploded perspective view of an electrical connection system 10 incorporating features of the present invention. Although the present invention will be described with reference to the embodiments shown in the drawings, it should be understood that the present invention can be embodied in many alternate forms of embodiments. In addition, any suitable size, shape or type of elements or materials could be used.

The electrical connection system 10 generally comprises a first connector 12 and a second connector 14. In this embodiment the first connector 12 is a coaxial electrical power connector with two areas 16 for two groups of power contacts. Preferably, each group of contacts includes a power supply and a power return. FIG. 1 shows a pair of contacts in only one of the areas 16 for illustration purposes only. However, features of the present invention could be incorporated into connectors having only one group of power contacts, more than two groups of power contacts, and/or also including signal contacts. The second connector 14 is also a coaxial electrical power connector, but only has one area and one group of contacts for mating with only one group of the contacts of the first connector 12. However, in alternate embodiments the second connector 14 could be made from a sandwich of conductive and insulative materials of more than one area and more than one group of contacts and, could also include signal contacts for mating with the signal contacts of the first connector.

The first connector 12 generally comprises a housing 18 and at least one group of power contacts or a contact assembly 20. In this embodiment the first connector 12 is generally intended to be mounted on an electronic component, such as a printed circuit board. Likewise, the second connector 14 is generally intended to be mounted on another electronic component, such as another printed circuit board. The housing 18 is comprised of a suitable dielectric material, such as a molded plastic or polymer material. However, any suitable housing could be provided.

Figure 2A:
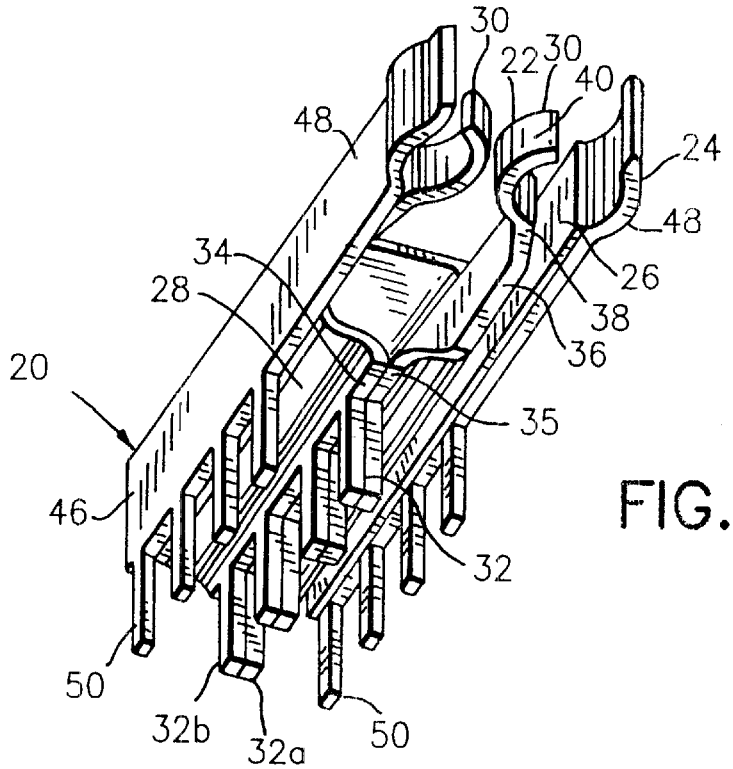
FIG. 2A is a perspective view of two of the contacts used in a first one of the connectors shown in FIG. 1.
Figure 2B:
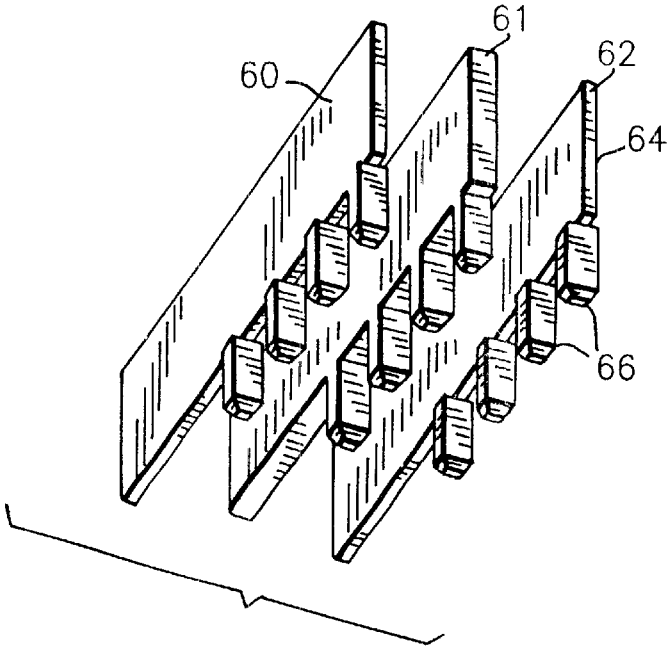
FIG. 2B is a perspective view of three of the contacts used in a second one of the connectors shown in FIG. 1.

The contact assembly 20 generally comprises an inner power contact 22, an outer power contact 24, and a spacer 26. Although shown as being inserted into housing 18, housing 18 could be overmolded around contact assembly 20. Referring also to FIG. 2A, the through hole mounted inner contact 22 generally comprises a base section 38, contact arms 30, and solder tails 32 at a mounting end.

In this embodiment the inner contact 22 is a one-piece member preferably stamped and formed from a suitable electrically conductive material, such as a flat sheet of copper alloy. However, in alternate embodiments the inner contact could be formed by any suitable method and/or with any suitable stock material. Furthermore, contact assembly 20 could be made from a sandwich of conductive and insulative materials.

The base section 28 has a general cross-sectional loop shape with two ends or edges 34, 35 being folded into positions located generally opposite each other. However, the base section 28 could have any suitable shape. The solder tails 32 extend from a bottom of the base section 28 from the edges 34, 35. In this embodiment the solder tails 32 are each comprised of two adjacent sections 32*a*, 32*b*; one section from each edge 34, 35. However, in alternate embodiments the solder tails could merely project from one of the edges, could be interspersed rather than ganged, and/or could project from the base section other than from an edge. In this embodiment the terminations at the mounting ends are through-hole solder tails. However, in alternate embodiments, the termination could be press-fit pins, surface mount solder tails or any other suitable type of connection.

Figure 3A:
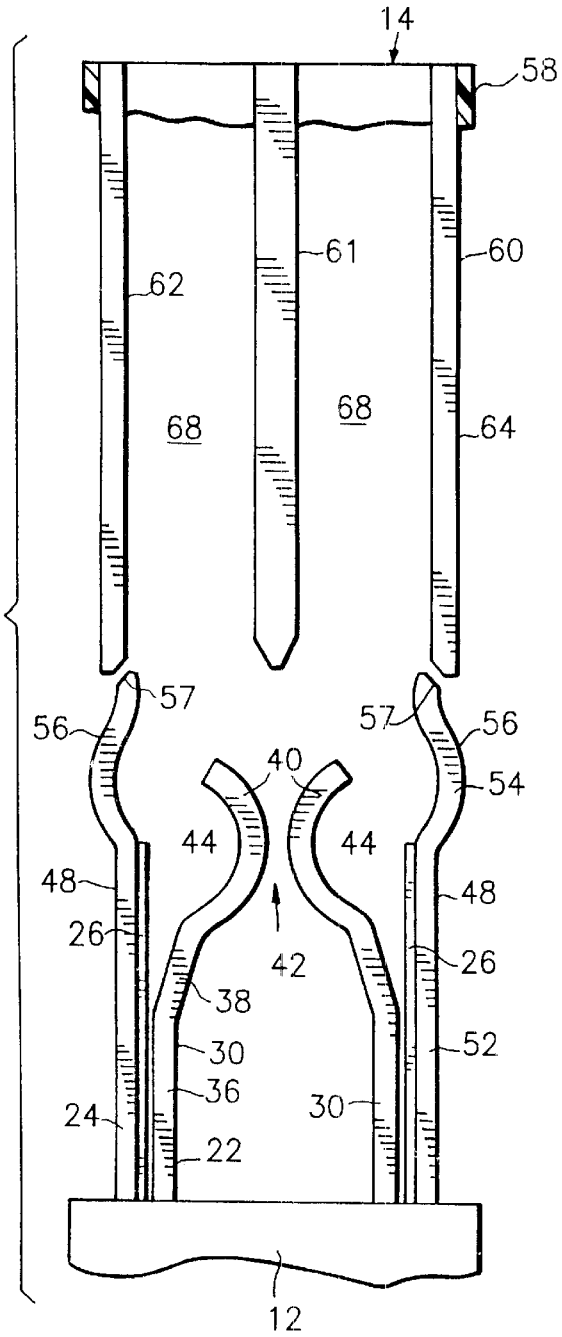
FIG. 3A is a schematic top plan view of portions of the contacts of the two connectors shown in FIG. 1 prior to connection.

Referring also to FIG. 3A, in this embodiment, the inner contact 22 has two of the contact arms 30. However, in alternate embodiments more than two contact arms could be provided. The two contact arms 30 project from a front end of the base section 28 from two opposite lateral sides in a general cantilever fashion. Each arm 30 may include a first section 36, a second section 38 and a third section 40 or may include any suitable shame (such as a continuously curvilinear shape). The first section 36 is substantially straight. The second section 38 is also substantially straight, but extends from the first section 36 at an inward angle. The third section 40 extends from the second section 38 and has a general curved profile. The two third sections 40 form a contact receiving area 42 therebetween and have contact surfaces 44 that are located opposite each other. The shape of the arm is selected so that, when the connectors mate, inner contacts 22 closely parallel outer contacts 24.

The outer contact 24 can be a one-piece member preferably stamped and formed from a suitable electrically conductive material, such as a flat sheet of copper alloy. However, the outer contact 24 could be comprised of more than one member and/or could be formed by any suitable method and/or with any suitable stock material. The outer contact 24 generally comprises a base section 46, contact arms 48, and solder tails 50. The base section 46 has a general cross-sectional "U" shape with a substantially open bottom side. The solder tails 50 extend down from opposite sides of the base section 46. In this embodiment the terminations are through-hole solder tails 50. However, in alternate embodiments any suitable termination could be provided, such as press-fit pins or surface mount solder tails. The contact arms 48 extend from the front of the base section 46 in a general cantilever fashion from two opposite sides. The contact arms 48 each comprise a first section 52 and a second section 54. The first section 52 comprises a substantially straight section. Preferably, the first sections 52 are substantially parallel to the first sections 36 of the inner contact 22 in order to control impedance. However, in alternate embodiments, the first sections 52 could have any suitable shape relative to the first sections 36 prior to connection with the mating connector 14. The second sections 54 extend from the first sections 52 and are curved with outward facing contact areas 56. The leading ends of the second sections 54 have outwardly sloped surfaces 57.

The spacer 26 generally comprises a dielectric material such as a polyester film or polyimide resin in the form of a film, such as KAPTON or MYLAR. However, any suitable dielectric material could be used. Preferably the spacer 26 is applied as a layer or coating on the inside surface of the outer contact 24. More specifically, the spacer 26 is applied to the interior surface of the three sides of the base section 46 and the inner facing surfaces of the contact arms 48. In an alternate embodiment the inner facing surfaces of the contact arms 48 need not have the spacer 26 applied thereto, such as when the contact arms 30, 48 are electrically insulated from each other by an air space therebetween. The spacer could alternatively or additionally be applied to the exterior surface of the base section 38 of the inner contact 22 and/or the outward facing surfaces of the contact arms 30. Any suitable means could be used to apply the spacer 26 to the contacts 22 and/or 24 such as spraying the spacer as a film onto the contact(s). However, the spacer 26 could be an insert. The spacer 26 is preferably very thin, such as less than about 30 mils (0.8 mm). In a preferred embodiment the spacer 26 is only about a few mils thick, such as about 10 mils (0.25 mm) or such as about 2 to 5 mils (0.05–0.125 mm).

After the spacer 26 is applied to the contact 22 and/or 24, the contacts 22, 24 are assembled into the contact assembly 20 and inserted into the housing 18. The base sections 28, 46 are preferably separated from each other merely by the spacer 26 such that the spacer 26 is sandwiched between the two base sections 28, 46. Thus, the two base sections 28, 46 are in very close proximity to each other. The contact arms 30, 48 are preferably separately deflectable relative to each other. The spacer 26 can be sandwiched between the arms 30, 48 or there could be a space or gap between the arms 30, 48 (i.e.: using air as the dielectric). The inner and outer contacts 22, 24 are kept in close proximity throughout the majority of the length of the connector 12.

The second connector 14 generally comprises a housing 58 and three contacts 60, 61, 62. The housing 58 is comprised of a suitable dielectric material, such as a molded plastic or polymer material. However, any suitable housing could be provided. The three contacts 60–62 each comprise a one-piece member formed from electrically conductive material, such as stamped and formed from a flat sheet of copper alloy. Each contact comprises a main section 64 and solder tails 66 extending from the main section. In this embodiment each main section 64 has a generally flat planar shape with a tapered leading edge; the center -contact 61 having a wedge shaped leading edge and the two outer contacts 60, 62 having inwardly sloped leading edges. The outer lateral sides of the two outer contacts 60, 62 are supported against the inner surfaces of the lateral sides of the housing 58. The three contacts 60–62 are also supported by the top and bottom sides of the housing 58. As described earlier, housing 18 could be overmolded around contact assembly 20. Receiving areas 68 are formed between the center contact 61 and the two outer contacts 60, 62. The solder tails 66 extend from the bottom of the housing 58. In this embodiment the terminations are through-hole solder tails, but any suitable termination could be provided, such as press-fit pins or surface mount solder tails.

Figure 3B:
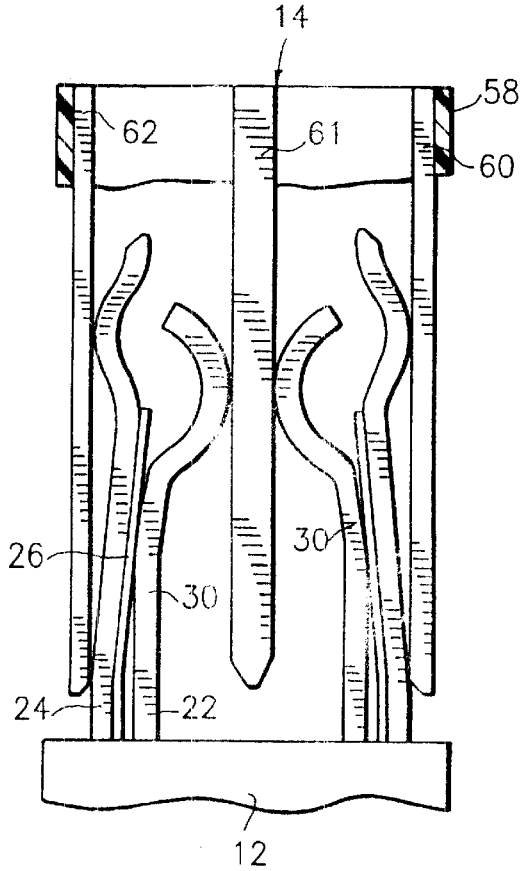
FIG. 3B is a schematic top plan view as in FIG. 3A when the two connectors are mated to each other.

Referring now particularly to FIGS. 3A and 3B, when the two connectors 12, 14 are mated with each other the inner contact 61 of the second connector 14 is received in the area 42 between the two contact arms 30 and makes electrical contact with surfaces 44. The two contact arms 30 are wedged outward slightly by the center contact 61. The bend between the two sections 36, 38 of each arm 30 at least partially straightens out. The two outer contacts 60, 62 of the second connector 14 are located along the outside of the outer contact arms 48. As the arms 60, 48 and 62, 48 come into contact with each other, the arms 48 are deflected inward with surfaces 56 making electrical contact with the arms 60, 62. Once connected, the contact arms 30, 48 of the first connector 12 are preferably substantially parallel to each other along their length (although a slightly out-of-parallel situation may exist at curved sections 40, 54). The spacer 26 can keep the contact arms 30, 48 electrically isolated from each other. Alternatively, if the spacer 26 is not provided at the contact arms 30, 48, an air gap or space could be provided between the contact arms 30, 48 when they are deflected.

What is needed in modern (computer) power applications is a low inductance power connector. A low inductance connector is a low impedance connector. Impedance is controlled by physical dimensions. So in this concept the inner and outer conductor members of the connector 12 are kept in close proximity throughout the majority of the length of the connector. The bodies of the inner and outer contacts are to be separated by a very thin dielectric, such as KAPTON® or MYLAR in a thickness of just a few mils (mil=1/1000 inch). The close proximity of the two contacts relative to each other (such as less than about 10 mils or only 2–5 mils) lowers inductance. The beams of the contacts, when deflected in their mated condition, are preferably nearly parallel along their length and could be insulated with a dielectric material or air.

With the embodiment described above, the two connectors 12, 14 can be used as coaxial power transmission connectors between two components. The contacts 22, 61 can supply electricity and the contacts 24, 60, 61 can function as a return. The contacts 22, 24 are kept in very close proximity to each other and in parallel along a majority of their lengths; the pairs of arms 30, 48 should also remain parallel or substantially parallel along a majority of their lengths. Thus, the connector 12 forms a low inductance power connector and a low impedance connector which can be particularly good to use for computer power applications to avoid problems which might otherwise be encountered by a non-low inductance power connector, such as the introduction of unwanted turn-on voltage transients or the generation of false signals or corruption of signals along nearby signal transmission pathways/contacts. The present intention, by providing a coaxial power connection with low inductance and low impedance can prevent, or at least substantially reduce, these problems occurring.

One will also note that the leads of the center contact 22 of the receptacle side are also formed so that leads 32 from both sides of the contact can enter one hole in a printed circuit board. This will keep a convenient, symmetrical hole pattern for easy application by a user.

Figure 4:
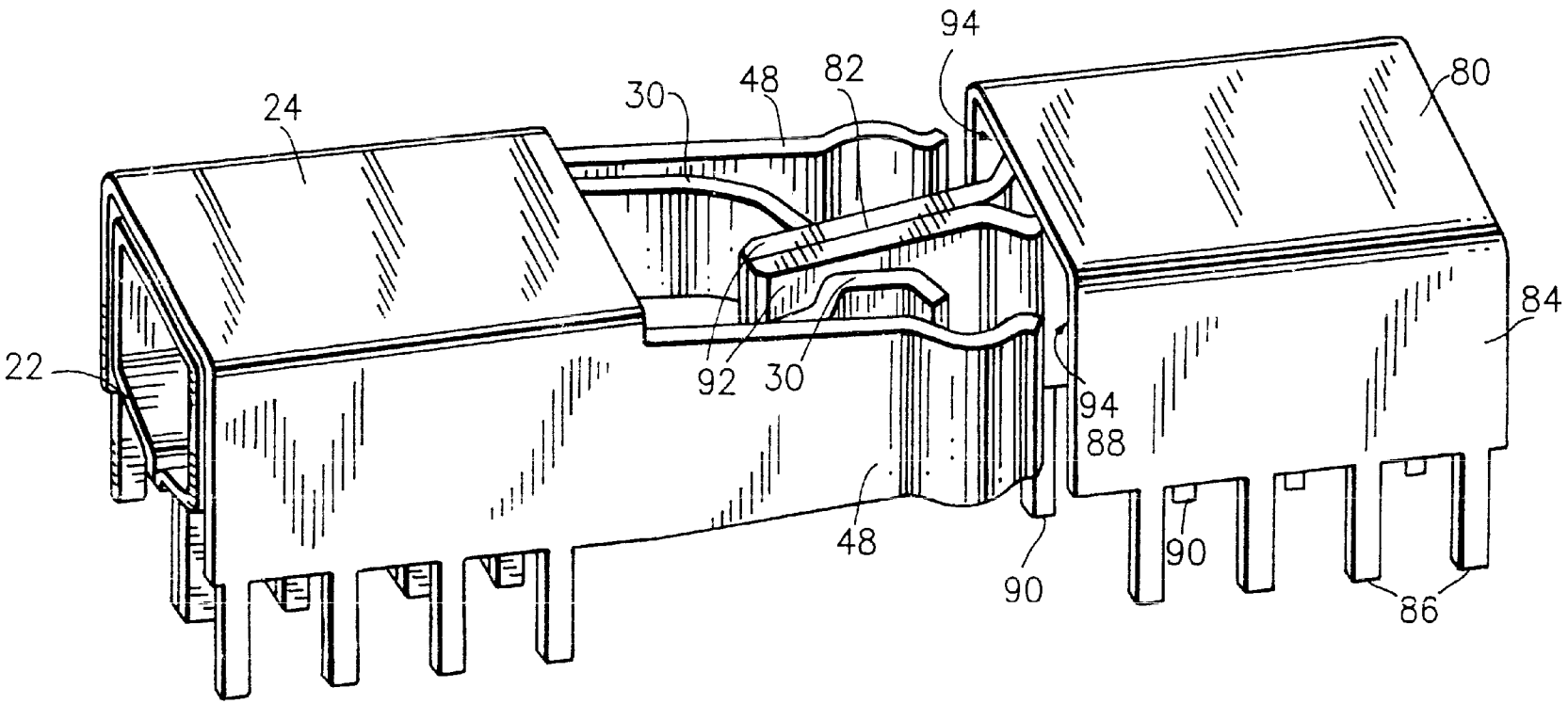
FIG. 4 is a schematic perspective view of contacts of two connectors of an alternate embodiment of the present invention.

On the header 14, two separate plates 60, 62 can be used to contact the outer receptacle contact 24. Alternatively, one could easily use a single formed contact. FIG. 4 shows one such alternative embodiment wherein the contacts of the two connectors are shown without their housings for the sake of clarity. In this embodiment the header connector comprises an outer contact 80 and an inner contact 82. The outer contact 80 comprises a one-piece member having a general "U" shaped main body 84 and solder tails 86 extending from both ends of the general "U" shape. The inner contact 82 is preferably a one-piece member which has been folded and includes a main body 88, solder tails 90, and two sections 92 extending from a front end of the main body 88. The two sections 92 are folded against each other and form a male contact section for insertion between the contact arms 30. The outer contact arms 48 can also be received in areas 94 and contact the interior surfaces of the lateral sides of the main body 84.

It should be understood that the foregoing description is only illustrative of the invention. Various alternatives and modifications can be devised by those skilled in the art without departing from the invention. Accordingly, the present invention is intended to embrace all such alternatives, modifications and variances which fall within the scope of the appended claims.

What is claimed is:

1. An electrical power connector comprising:

a housing;

a first power contact connected to the housing, the first contact comprising a base section and at least two cantilevered contact arms projecting outwardly from said base, said contact arms including planar portions; and a second power contact connected to the housing, the second contact comprising a base section and at least two cantilevered contact arms projecting outwardly from said base and located outside and generally parallel to planes of the planar portions of the cantilevered contact arms of the first contact.

2. A connector as in claim 1 wherein the first and second contacts comprise one-piece stamped and formed members.

3. A connector as in claim 1 wherein one of said base sections comprises a general loop shape with at least one solder tail extending from the general loop shape.

4. A connector as in claim 3 wherein the first contact comprises a one-piece stamped and formed member, and wherein the base section comprises two edges of the one-piece member being located opposite each other and having the at least one solder tail extend from a location proximate the two edges.

5. A connector as in claim 1 further comprising a dielectric spacer located between the first and second contacts along the majority of their lengths.

6. A connector as in claim 5 wherein the dielectric spacer is located between portions of the first and second contacts.

7. A connector as in claim 6 wherein the dielectric spacer is located between the contact beams of the first contact and the contact beams of the second contact.

8. A connector as in claim 7 wherein the contact beams of the first contact are independently deflectable relative to the contact beams of the second contact.

9. A connector as in claim 8 wherein the contact beams are deflectable by a mating connector to sandwich portions of the dielectric spacer between the contact beams of the first and second contacts.

10. A connector as in claim 5 wherein the dielectric spacer comprises a layer of dielectric material and having a thickness of about 2 to 5 mils (0.05–0.125 mm).

11. The connector according to claim 1, wherein the first and second contacts are located in close proximity relative to each other of less than about 30 mils (0.08 mm) along a majority of their lengths.

* * * * *